US008721298B2

(12) United States Patent
Tanimoto et al.

(10) Patent No.: US 8,721,298 B2
(45) Date of Patent: May 13, 2014

(54) AIR BLOWER

(75) Inventors: Hideyuki Tanimoto, Hitachinaka (JP); Takuya Konnai, Hitachinaka (JP); Kouji Sagawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 73 days.

(21) Appl. No.: 12/941,590

(22) Filed: Nov. 8, 2010

(65) Prior Publication Data

US 2011/0110798 A1 May 12, 2011

(30) Foreign Application Priority Data

Nov. 6, 2009 (JP) ..... 2009-255582
Dec. 11, 2009 (JP) ..... 2009-282247
Nov. 8, 2010 (JP) ..... 2010-249376

(51) Int. Cl.
*F04D 29/00* (2006.01)

(52) U.S. Cl.
USPC ..... 417/234

(58) Field of Classification Search
USPC ..... 417/234; 15/300.1
See application file for complete search history.

(56) References Cited

U.S. PATENT DOCUMENTS 3,997,806 A * 12/1976 Noto et al. ..... 310/268
4,694,528 A * 9/1987 Comer et al. ..... 15/330
4,884,314 A * 12/1989 Miner et al. ..... 15/344

FOREIGN PATENT DOCUMENTS

JP 2006-083831 3/2006

* cited by examiner

*Primary Examiner* — Charles Freay
*Assistant Examiner* — Philip Stimpert
(74) *Attorney, Agent, or Firm* — McDermott Will & Emery LLP

(57) ABSTRACT

An air blower comprises a motor including a rotor, a stator, and an output shaft fixed to the rotor, a fan that rotates by receiving power from the motor, a casing that retains the motor and the fan, and a handle provided at the casing. The rotor has a coil disc including a plurality of substantially annular coils arranged in the circumferential direction around the output shaft as viewed from the direction of the axial line of the output shaft. The stator has a magnetic flux generating mechanism that generates magnetic fluxes passing through the coil disc in the direction of the axial line of the output shaft.

14 Claims, 11 Drawing Sheets

AIR BLOWER

CROSS-REFERENCE TO RELATED APPLICATION

This application claims the benefit of Japanese Patent Application No. 2009-255582, filed on Nov. 6, 2009, Japanese Patent Application No. 2009-282247, filed on Dec. 11, 2009, and Japanese Patent Application No. 2010-249376, filed on Nov. 8, 2010, the entire disclosure of which is incorporated by reference herein.

FIELD

This application relates generally to an air blower having a motor as a drive source.

BACKGROUND

Unexamined Japanese Patent Application KOKAI Publication No. 2006-83831 discloses an air blower comprising a motor, a fan rotatingly driven by the motor, a casing retaining the motor and the fan thereinside, an air inlet opening and an air outlet opening both formed on the casing, and a handle provided at the casing. This air blower suctions air through the air inlet opening by the rotation of the fan, and blows out the air through the air outlet opening. An attachment, such as a nozzle, a hose pipe, or a dust collecting bag, can be attached to the air inlet opening and the air outlet opening. As the hose pipe or the nozzle is attached to the air outlet opening, the air blower functions as a blower that blasts off powder dusts or the like. Moreover, as the hose pipe or the nozzle is attached to the air inlet opening, and the dust collecting bag is attached to the air outlet opening, the air blower can function as a dust collector that collects powder dusts or the like.

According to the conventional air blower, however, because the motor largely protrudes in a direction vertical to the rotational plane of the fan, the workability thereof at a narrow space like a place against a wall is poor. Moreover, because the handle is arranged in the vicinity of the motor, when the attachment is attached to the air inlet opening or the air outlet opening of the casing, the weight balance becomes unbalanced, resulting in a poor workability.

SUMMARY

The present invention has been made in view of the foregoing circumstance, and it is an object of the present invention to provide an air blower which is further small in size with a good weight balance, and has a good workability.

In order to achieve the above object, an air blower according to the present invention comprises: a motor including a rotor, a stator, and an output shaft fixed to the rotor, one of the rotor and the stator including a coil disc with a plurality of coil pieces arranged in a circumferential direction around the output shaft as viewed from a direction of an axial line of the output shaft, and another of the rotor and the stator including a magnetic flux generating mechanism that generates a magnetic flux passing through the coil disc in the direction of the axial line of the output shaft; a fan which rotates by receiving power from the motor; a casing which retains the motor and the fan, and which is provided with an air inlet opening for suctioning air and an air outlet opening for blowing out the air; and a handle provided at the casing.

It is desirable that the coil disc comprise a print wiring board where a conductor pattern of the coil piece is formed.

It is desirable that the rotor and the fan be provided together so as to be adjoined to each other in the direction of the axial line of the output shaft.

It is desirable that the handle be arranged so as to be apart from the motor and the fan in a direction substantially vertical to the axial line of the output shaft.

It is desirable that the air outlet opening and the handle be arranged on a substantially same plane.

The casing may comprise: a motor case for retaining the rotor; and a fan case which retains the fan and which is provided with the air inlet opening and the air outlet opening, and the handle may be arranged on the fan case.

The casing may comprise: a motor case for retaining the rotor; and a fan case which retains the fan and which is provided with the air inlet opening and the air outlet opening, and the handle may be arranged on and across the motor case and the fan case.

It is desirable that the handle be formed together with the casing.

It is desirable that the handle be formed together with the fan case.

The handle may comprise first and second handle members joined together in the direction of the axial line of the output shaft, and either one of the first and second handle members may be formed together with the fan case or the motor case.

It is desirable that an external diameter of the coil disc be larger than an external diameter of the fan.

It is desirable that the magnetic flux generating mechanism include a magnet.

The air blower may further comprise a battery pack, wherein the battery pack and the air outlet opening and the handle are arranged on a substantially same plane.

According to the present invention, there is provided an air blower which is further small in size with a good weight balance, and has a good workability.

BRIEF DESCRIPTION OF THE DRAWINGS

A more complete understanding of this application can be obtained when the following detailed description is considered in conjunction with the following drawings, in which.

DETAILED DESCRIPTION

<First Embodiment>

Figure 1A:
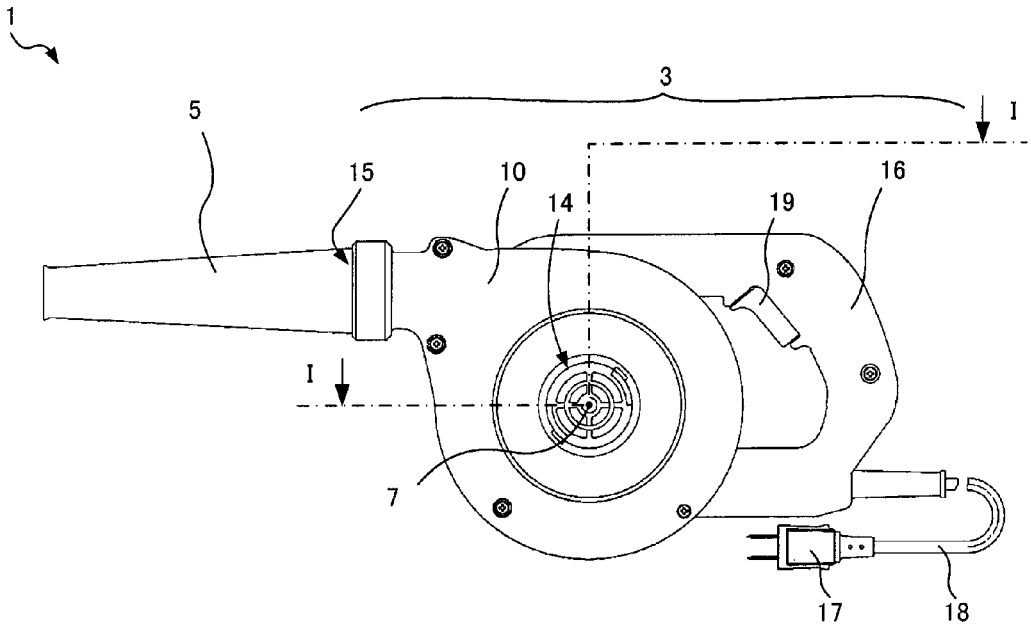
FIG. 1A is a side view showing an air blower according to a first embodiment of the present invention.
Figure 1B:
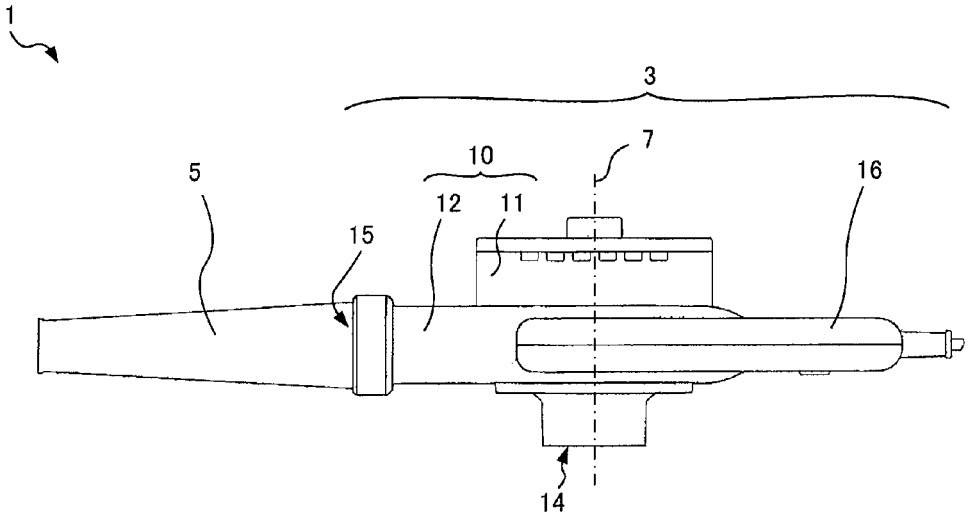
FIG. 1B is a top view showing the air blower according to the first embodiment of the present invention.
Figure 2:
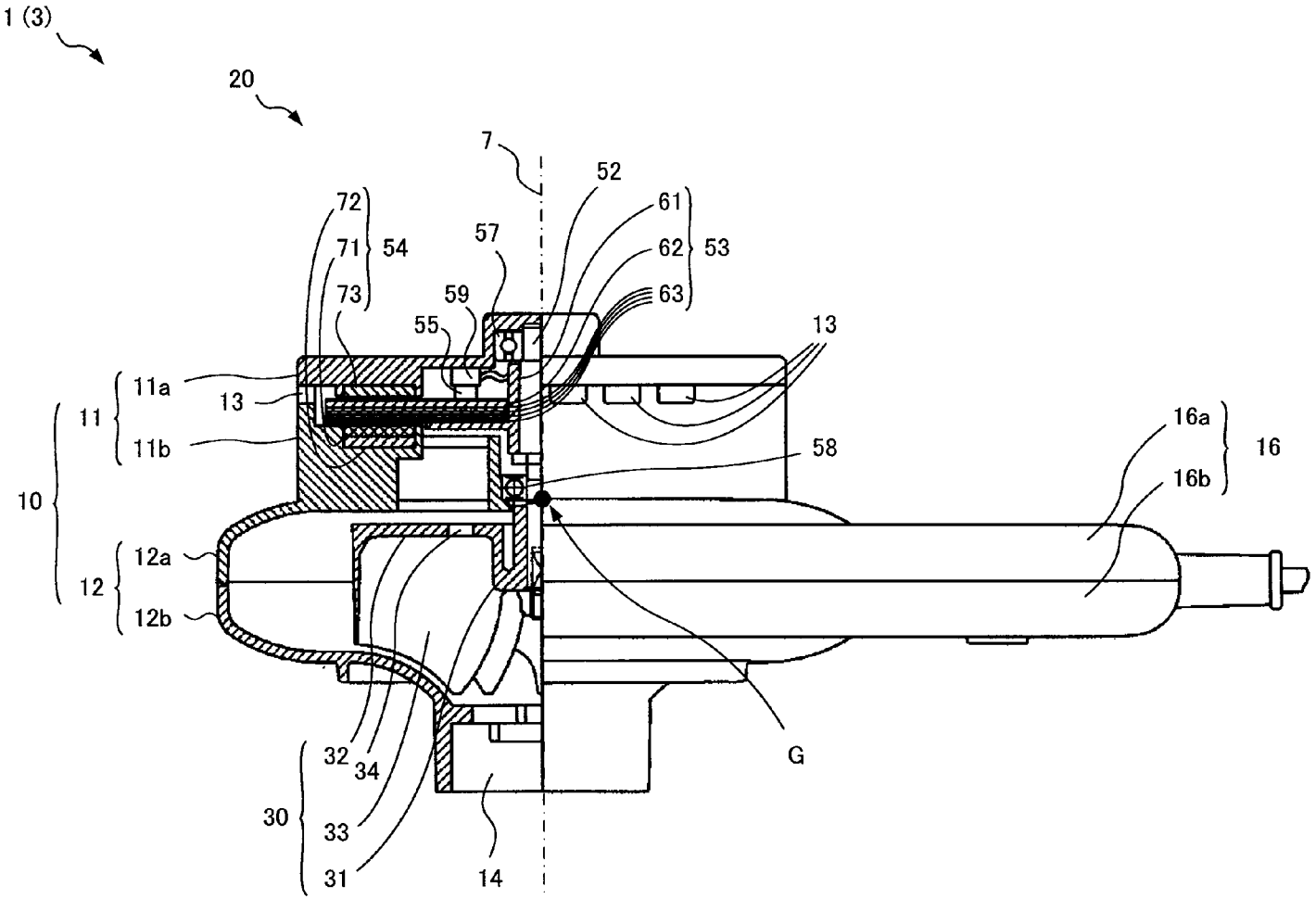
FIG. 2 is a view along a line I-I in FIG. 1A.

FIG. 1A is a side view showing an illustrative air blower 1 according to a first embodiment of the present invention. FIG. 1B is a top view showing the illustrative air blower 1 according to the first embodiment of the present invention. FIG. 2 is a view along a line I-I in FIG. 1A. As shown in the figures, the air blower 1 comprises a main body 3, and a nozzle 5 attached to the main body 3.

As shown in FIG. 2, the main body 3 includes a casing 10 forming an outer edge of the main body 3, a motor 20 retained in the casing 10, and a fan 30 driven by the power output by the motor 20.

The casing 10 includes a motor case 11 for retaining the motor 20, and a fan case 12 for retaining the fan 30. The motor case 11 and the fan case 12 are arranged side by side in the direction of an axial line 7 of the rotational shaft of the motor 20. Moreover, the motor case 11 comprises two pieces of cases 11*a*, 11*b* joined and fastened in the direction of the axial line 7. The fan case 12 comprises two pieces of cases 12*a*, 12*b* joined and fastened in the direction of the axial line 7. According to the present embodiment, the case 11*b* of the motor case 11 and the case 12*a* of the fan case 12 adjoining in the direction of the axial line 7 are an integral piece.

A plurality of ventilation openings 13 for inletting air (external air) into the motor case are formed on the motor case 11.

Formed in the fan case 12 are an air inlet opening 14 for suctioning external air and an air outlet opening 15 for blowing out the suctioned air. The air inlet opening 14 protrudes in a direction opposite to the motor 20 from the casing 12*b*, and is formed in a circular cylindrical shape. The air outlet opening 15 protrudes in a direction (a tangential line of the fan 30) substantially vertical to the axial line 7 from the fan case 12, and is formed in a circular cylindrical shape. It is possible for the air blower 1 to attach an attachment, such as a dustproof cover for preventing any dirt from entering into the interior of the fan case 12, a hose piece, or a nozzle, to the air inlet opening 14. Moreover, it is also possible for the air blower 1 to attach an attachment, such as the nozzle 5 shown in FIG. 1, a hose piece, or a dust collecting bag, to the air outlet opening 15.

The casing 10 is provided with a handle 16. The handle 16 is arranged on the fan case 12. The handle 16 comprises two pieces of handle members 16*a*, 16*b* joined and fastened in the direction of the axial line 7. The handle members 16*a*, 16*b* are integrally formed with the cases 12*a*, 12*b*, respectively, both forming the fan case 12. In the present embodiment, as shown in FIG. 1B, the handle 16 and the air outlet opening 15 are arranged on substantially same plane.

As shown in FIG. 1A, the handle 16 is provided with a power cord 18 with a power plug 17, and a trigger switch 19. As the power plug 17 is connected to an external AC power source, the power cord 18 supplies power from the AC power source to a non-illustrated power-source circuit retained in the casing 10. The power-source circuit converts the power from the AC power source to a predetermined DC voltage, and supplies the DC voltage to the motor 20. The trigger switch 19 switches the output voltage by the power-source circuit, and has a function of adjusting the output voltage by the power-source circuit depending on the pushed level. Accordingly, the motor 20 is actuated/deactivated by operating the trigger switch 20, and the output (the number of rotation) by the motor 20 can be also adjusted.

The motor 20 comprises a commutator motor which receives power and which outputs driving force to an output shaft 52, and as shown in FIG. 2, includes the output shaft 52, a rotor 53 that rotates together with the output shaft 52, a stator 54 fixed to the casing 10, and a pair of sliders 55.

The output shaft 52 is supported by bearings 57, 58 provided at the motor case 11 so as to be rotatable around the axial line 7. One end of the output shaft 52 protrudes from the motor case 11 to the fan case 12, and is connected to the fan 30.

Figure 3:
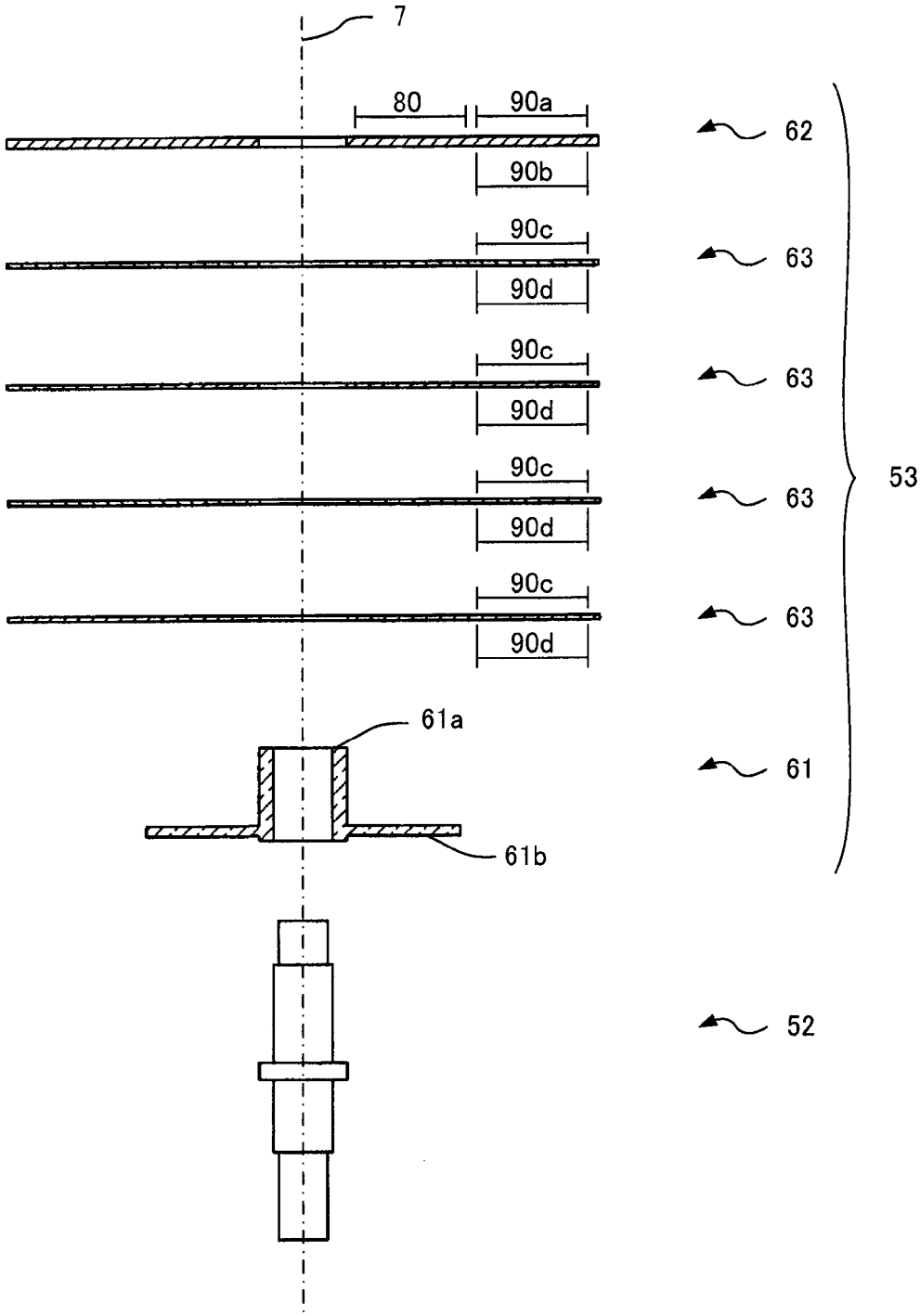
FIG. 3 is a cross-sectional view showing a rotor and an output shaft exploded in FIG. 2.

The rotor 53 is provided together with the output shaft 52, is formed in a discoid shape around the axial line 7, and is retained in the motor case 11. As shown in FIG. 3, the rotor 53 comprises a flange 61, a coil/commutator disc 62, and four coil discs 63.

The flange 61 is formed of, for example, an aluminum alloy, and has a cylindrical fixing member 61*a* around the axial line 7 and a discoid support member 61*b* protruding in a direction substantially vertical to the axial line 7 from the outer circumference surface of the fixing member 61*a*. The flange 61 has the fixing member 61*a* fixed to and engaged with the output shaft 52 so as not to rotate alone, and rotates together with the output shaft 52.

The coil/commutator disc 62 and the coil disc 63 are each a print wiring board including an insulating substrate and a conductor pattern. The coil/commutator disc 62 and the coil disc 63 are each formed in a discoid shape having substantially same internal diameter and external diameter around the axial line 7, and are stacked together on the support member 61*b* of the flange 61 with the coil/commutator disc 62 being the outermost layer.

As shown in FIG. 3, provided on the top face of the coil/commutator disc 62 are a commutator area 80 where a commutator conductor pattern is formed, and a coil area 90*a* where a coil conductor pattern is formed. The commutator area 80 and the coil area 90*a* are each provided as an annular area around the axial line 7, and the coil area 90*a* is arranged outwardly of the commutator area 80. Moreover, provided on the bottom face of the coil/commutator disc 62 is a coil area 90*b* for forming a coil conductor pattern. The coil area 90*b* is provided so as an annular area around the axial line 7, and is arranged so as to overlap the coil area 90*a* as viewed from the direction of the axial line 7.

Figure 4:
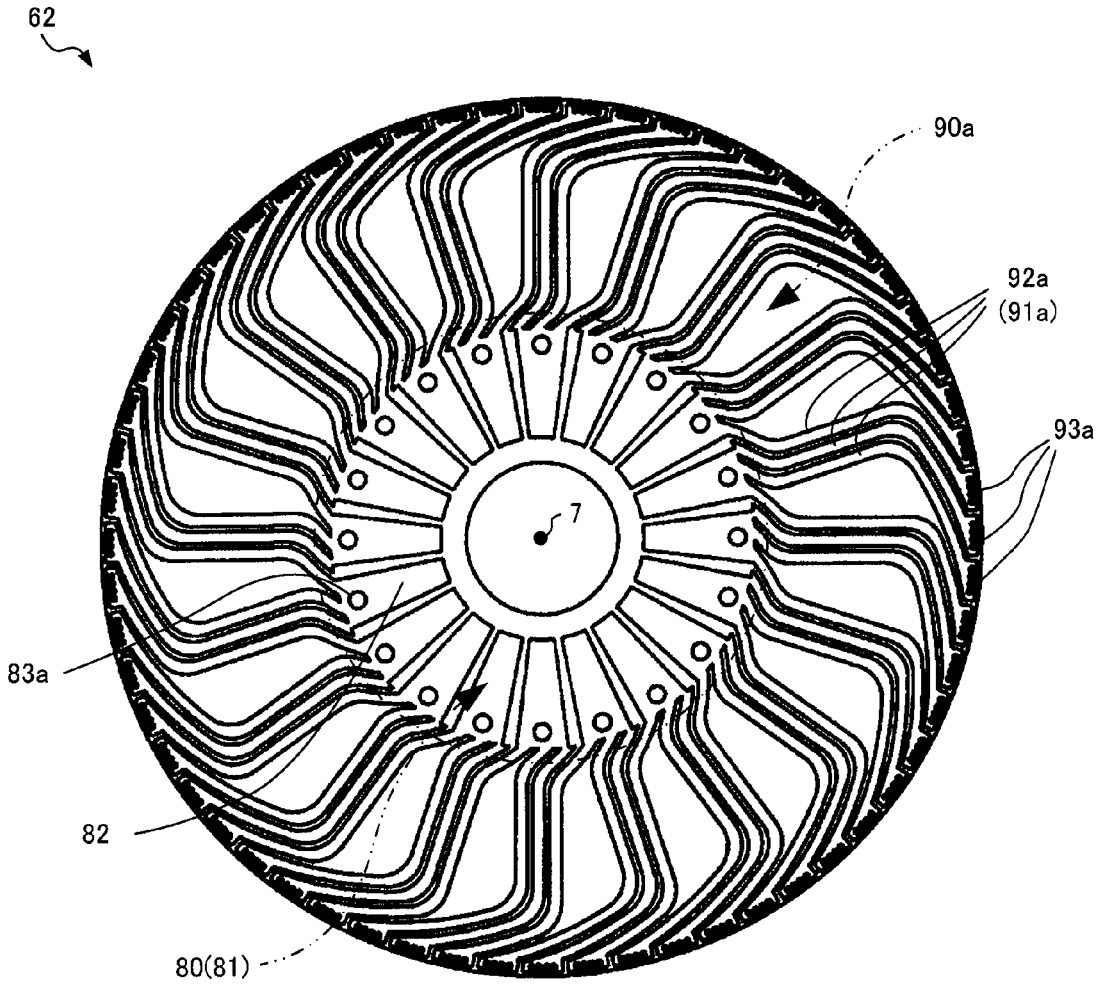
FIG. 4 is a top view showing a conductor pattern of a coil/commutator disc in FIG. 3.

As shown in FIG. 4, the commutator area 80 on the top face of the coil/commutator disc 62 has a commutator 81 formed by the conductor pattern. The commutator 81 comprises a plurality of commutator pieces 82 formed radially around the axial line 7. A through hole 83*a* that passes all the way through the coil/commutator disc 62 is formed in the outer end of each commutator piece 82.

The coil area 90*a* on the top face of the coil/commutator disc 62 has a plurality of coil pieces 92*a* formed by the conductor pattern and formed radially around the axial line 7. Each coil piece 92*a* has an inner end directly connected to the corresponding commutator piece 82. Moreover, each coil piece 92*a* has an outer end bent in a predetermined direction around the axial line 7. A plurality of through holes 93*a* passing all the way through the coil/commutator disc 62 are formed in the outer end of each coil piece 92*a*.

The coil area 90*b* on the bottom face of the coil/commutator disc 62 has a plurality of non-illustrated coil pieces formed by the conductor pattern similar to that of the coil area 90*a* shown in FIG. 4 and formed radially around the axial line 7. The outer end of each non-illustrated coil piece is connected to the corresponding coil piece 92*a* of the coil area 90 through a solder filled in the through holes 93*a*. Moreover, the inner end of each non-illustrated coil piece is connected to the corresponding commutator piece 82 of the commutator area 80 through a solder filled in the through hole 83*a*. Accordingly, the plurality of coil pieces 92*a* of the coil area 90*a* and the plurality of non-illustrated coil pieces of the coil area 90*b* form a plurality of coils 91*a* formed in a substantially annular shape (substantially rectangular shape with a side being omitted) as viewed from the direction of the axial line 7. The plurality of coils 91*a* are arranged in a circumferential direction around the axial line 7. The end of each coil 91*a* is connected to the corresponding commutator piece 82 of the commutator area 80.

As shown in FIG. 3, coil areas 90*c*, 90*d* where coil conductor patterns are formed are provided on the top face and the bottom face of the coil disc 63, respectively. The coil areas 90*c*, 90*d* are each formed in an annular shape around the axial line 7, and are arranged so as to overlap the coil areas 90*a*, 90*b* of the coil/commutator disc 62.

Figure 5:
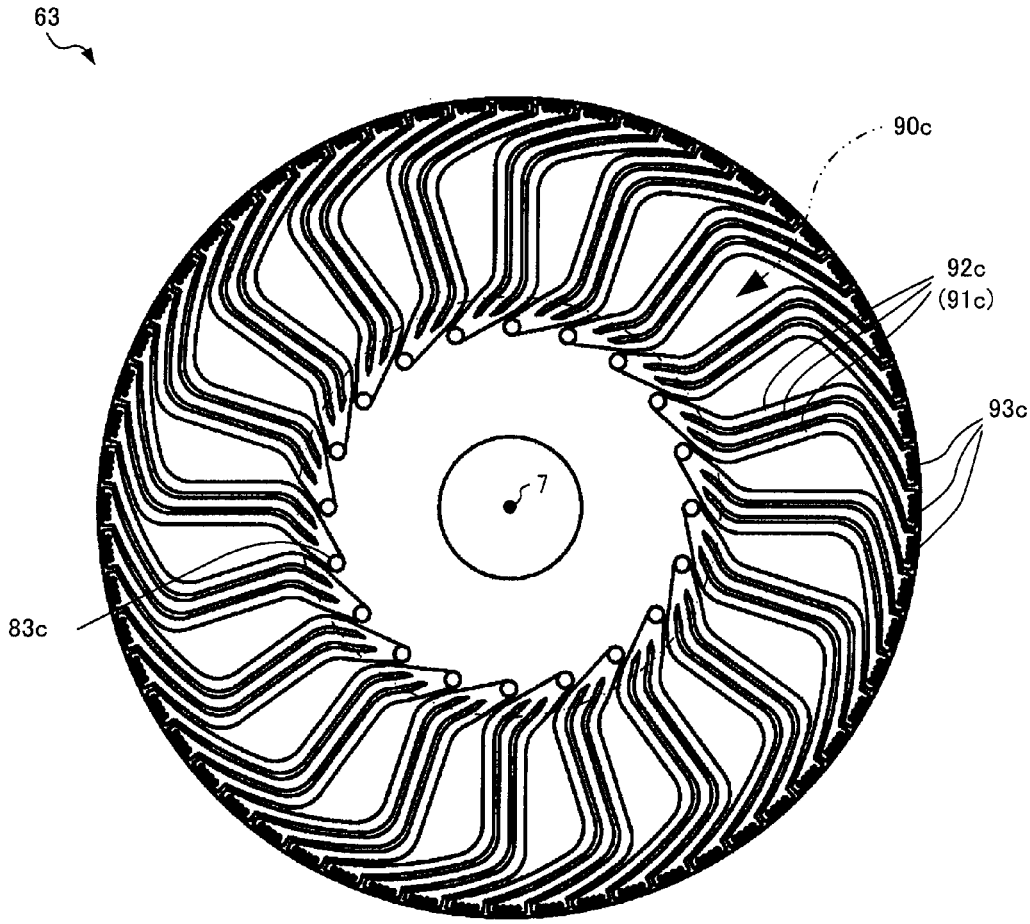
FIG. 5 is a top view showing a conductor pattern of a coil disc in FIG. 3.

The coil areas 90*c*, 90*d* of the coil disc 63 have conductor patterns similar to those of the coil areas 90*a*, 90*b* of the coil/commutator disc 62. As shown in FIG. 5, the coil area 90*c* on the top face of the coil disc 63 has a plurality of coil pieces 92*c* formed radially around the axial line 7. Moreover, the coil area 90*d* on the bottom face of the coil disc 63 has a plurality of non-illustrated coil pieces formed by the similar conductor pattern to that of the coil area 90*c*. The plurality of coil pieces 92*c* of the coil area 90*c* and the plurality of non-illustrated coil pieces of the coil area 90*d* are respectively connected through solders filled in respective through holes 83*c*, 93*c* passing all the way through the coil disc 63, and form a plurality of coils 91*c* formed substantially in an annular (substantially rectangular shape with a side being omitted) as viewed from the direction of the axial line 7. The plurality of coils 91*c* are arranged in a circumferential direction around the axial line 7. The end of each coil 91*c* is connected to the corresponding commutator piece 82 through a solder filled in the through hole 83*a* of the coil/commutator disc 62.

Respective conductor patterns of the commutator area 80 and the coil area 90*a* of the coil/commutator disc 62 are formed on the same print wiring. Respective conductor patterns of the commutator area 80 and the coil area 90*a* of the coil/commutator disc 62 are formed so as to be thicker than that of the coil area 90*b* and those of the coil areas 90*c*, 90*d* of the coil disc 63 in order to suppress a damage originating from ablation with the sliders 55.

The coil/commutator disc 62 and the coil disc 63 are stacked together via a non-illustrated insulating layer in such a way that, for example, the coils 91*a*, 91*c* overlap as viewed from the direction of the axial line 7 or the coils 91*a*, 91*c* are arranged with a predetermined angle around the axial line 7.

As shown in FIG. 2, the stator 54 comprises a magnet 71 that is a permanent magnet, and a pair of yokes 72, 73. The pair of yokes 72, 73 are each formed of a magnetic material like iron in an annular discoid shape, and are fixed to the motor case 11. The yoke 72 is arranged in the case 11*b* so as to face the bottom face of the rotor 53, more specifically, so as to face the coil area 90*d* (see FIG. 3) of the coil disc 63. The yoke 73 is arranged in the case 11*a* so as to face the top face of the rotor 53, more specifically, so as to face the coil area 90*a* (see FIG. 3) of the coil/commutator disc 62. The magnet 71 is formed in an annular shape with a plurality of magnetic poles arranged in a circumferential direction, and is fixed to the top face of the yoke 72. Accordingly, the pair of yokes 72, 73 form a magnetic path so that magnetic fluxes generated by the magnet 71 pass through the coil/commutator disc 62 and the coil disc 63 in the direction of the axial line 7. The magnet 71 and the yokes 72, 73 configure a magnetic flux generating mechanism of the present invention.

The pair of sliders 55 are held by a pair of slider holders 59 fixed to the motor case 11 so as to slidingly contact the top face of the rotor 53, more specifically, so as to slidingly contact the pair of commutator pieces 82 of the coil/commutator disc 62 (see FIG. 4), and are arranged across the axial line 7. The sliders 55 are urged toward the top face of the rotor 53 by urging means like a non-illustrated spring provided at the slider holders 59. The slider 55 is formed of a carbon with an electrical conductivity, and is connected to the above-explained power-source circuit. The slider holders 59 are each provided with a non-illustrated cap which is threaded with the slider holder 59 and which is detachable from the exterior of the motor case 11 (the case 11*a*), and as the cap is detached, the slider 55 can be replaced without disassembling the motor case 11.

The fan 30 is coupled to the output shaft 52 of the motor 20, and is retained in the fan case 12. The fan 30 is a centrifugal fan that comprises an attaching member 31 threaded and fixed to the output shaft 52, a discoid substrate member 32 extending from the attaching member 31 substantially vertical to the axial line 7, and a plurality of blades 33 extending from the substrate member 32 opposite to the motor 20. A ventilation opening 34 for suctioning air in the motor case 11 in between the plurality of blades 33 is formed in the substrate member 32. The plurality of blades 33 bend in the direction opposite to the rotating direction of the fan 30 as going outwardly to the external-diameter side of the fan 30 as viewed from the direction of the axial line 7, and are formed in a spiral shape.

According to the air blower 1 having the above-explained structure, as the trigger switch 19 is actuated, a predetermined voltage is applied to the sliders 55 of the motor 20 from the non-illustrated power-source circuit. The voltage applied to the sliders 55 is applied to the coils 91*a*, 91*c* of the rotor 53 through the commutator 81. Thereafter, the coils 91*a*, 91*c* of the rotor 53 form magnetic fluxes in the direction of the axial line 7 by the stator 54 as explained above, a current starts flowing in the direction vertical to the magnetic fluxes and orthogonal to the axial line 7 by the applied voltage through the commutator 81, and rotational force is generated at the rotor 53 around the axial line 7. Accordingly, the rotor 53, the output shaft 52 fixed to the rotor 53, and the fan 30 connected to the output shaft 52 rotate together as the axial line 7 being a rotational axis.

As the fan 30 rotates, air (external air) is suctioned in the fan case 12 through the air inlet opening 14. The air suctioned in the fan case 12 enters in between the plurality of blades 33 of the fan 30, rotates together with the fan 30, flows in the external-diameter direction of the fan 30, travels along the internal wall of the fan case 12, and is blown out from the air outlet opening 15.

Moreover, as the fan 30 rotates, air (external air) is suctioned into the motor case 11 through the ventilation openings 13. The air suctioned in the motor case 11 cools down the coil/commutator disc 62 and the coil disc 63 of the motor 20, is suctioned in between the plurality of blades 33 in the fan case 12 through the ventilation opening 34 formed in the substrate member 32 of the fan 30, joins the air suctioned from the air inlet opening 14, and is blown out from the air outlet opening 15.

If the hose pipe or the nozzle is attached to the air outlet opening 15, the air blower 1 can function as a blower that blasts off powder dusts or the like. Moreover, if the hose pipe or the nozzle is attached to the air inlet opening 14 and the dust collecting bag is attached to the air outlet opening 15, the air blower 1 can function as a dust collector that collects powder dusts or the like.

As explained above, the motor 20 with the foregoing structure comprises the rotor 53 including the discoid coil/commutator disc 62 and coil disc 63 having the coils 91*a*, 91*c* arranged in the circumferential direction around the axial line 7 (the axial line of the output shaft 52), and the stator 54 including the magnet 71 and the yokes 72, 73 which generate magnetic fluxes passing through the coil/commutator disc 62 and the coil disc 63 in the direction of the axial line 7. Accordingly, in comparison with the motor of the air blower disclosed in Unexamined Japanese Patent Application KOKAI Publication No. 2006-83831, the motor 20 is in a shape which has a small width in the direction of the axial line 7, is flat and is small in size.

Moreover, the coil/commutator disc 62 and the coil disc 63 configuring the rotor 53 of the motor 20 each comprise a print wiring board where the conductor pattern of the coil 91*a* or 91*c* is formed. Accordingly, in comparison with a motor having a coil wound around a so-called core formed of a magnetic material like iron, the rotor 53 is light-weighted, so that the motor 20 is light-weighted and is quick to actuate. Moreover, because the rotor 53 has no so-called coil end (a bent portion out of a core in a coil wound around the core), the motor 20 can be further flat and small in size, and heat generation by the coils 91*a*, 91*c* can be suppressed. Furthermore, because the surface area of the rotor 53, i.e., the heat dissipation area is large, the motor 20 has a good cooling efficiency for the coils 91*a*, 91*c*. Therefore, an output reduction of the motor 20 originating from overheating of the coils 91*a*, 91*c* can be suppressed, and means for cooling the coils 91*a*, 91*c* can be simplified such that the ventilation opening 13 formed in the motor case 11 for retaining the motor 20 thereinside can be reduced in size or omitted.

Because the air blower 1 of the above-explained structure has the above-explained flat and small motor 20, in comparison with the conventional air blowers (e.g., the air blower disclosed in Unexamined Japanese Patent Application KOKAI Publication No. 2006-83831), the width of the casing 10 in the direction of the axial line 7 which retains the motor 20 and the fan 30 can be reduced, resulting in a good workability at a narrow space like a place against a wall.

The handle 16 provided at the casing 10 is arranged so as to be apart from the motor 20 and the fan 30 in a direction substantially vertical to the axial line 7, so that it is not necessary to extend the width of the casing 10 in the direction of the axial line 7.

Moreover, because the handle 16 is arranged on the fan case 12, the position of the air outlet opening 15 and the position of the handle 16 both in the direction of the axial line 7 are close to each other. In addition, because the air outlet opening 15 of the fan case 12 and the handle 16 are arranged on substantially same plane, the position of the air outlet opening 15 is consistent with the position of the handle 16 in the direction of the axial line 7. Accordingly, the air blower 1 has a good workability when used as, in particular, a blower that blasts off powder dusts when the nozzle 5 or the like is attached to the air outlet opening 15.

Because the motor 20 is flat and light-weighted, the weighted center position G (see FIG. 2) of the air blower 1 in the direction of the axial line 7 is close to the fan case 12 in comparison with the conventional air blowers. Therefore, because the handle 16 is arranged on the fan case 12, the weighted center position G of the air blower 1 and the position of the handle 16 are close to each other in the direction of the axial line 7, resulting in a good weight balance. Moreover, because the handle 16 is arranged on the fan case 12, even if the attachment, such as the nozzle 5, the hose pipe, or the dust collecting bag, is attached to the air inlet opening 14 or the air outlet opening 15, the misalignment between the weighted center position G of the air blower 1 and the position of the handle 16 is small in the direction of the axial line 7, resulting in a good weight balance. Therefore, according to the air blower 1 with the above-explained structure, a load to a user originating from a poor weight balance can be reduced, thereby improving the workability.

Moreover, because the handle 16 (the handle members 16*a*, 16*b*) and the fan case 12 (the cases 12*a*, 12*b*) are formed together, the manufacturing cost of a part and an assembling cost of the product can be reduced.

Moreover, as shown in FIG. 2, because the external diameter of the coil/commutator disc 62 and that of the coil disc 63 are set to be larger than that of the fan 30, the coils 91*a*, 91*c* can be arranged so as to be spaced apart from the axial line 7, thereby improving the output (the torque) of the motor 20. However, in order to prevent the air blower 1 from becoming large in size, it is desirable that the contour of the motor case 11 be smaller than the contour of the fan case 12 as viewed from the direction of the axial line 7.

<Second Embodiment>

Figure 6:
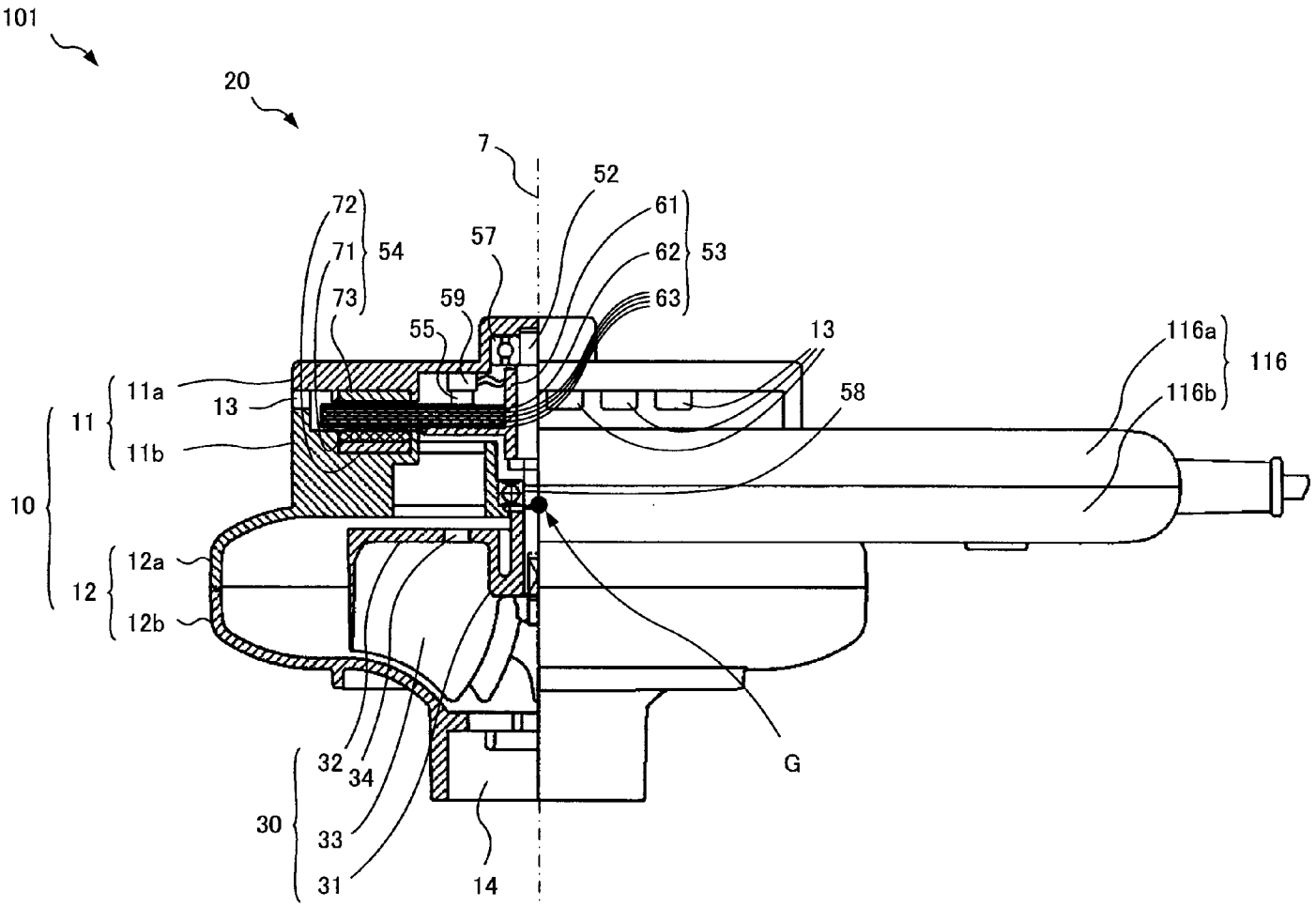
FIG. 6 is a cross-sectional view corresponding to FIG. 2 and showing an air blower according to a second embodiment of the present invention.

FIG. 6 is a cross-sectional view showing an air blower 101 according to a second embodiment and corresponding to FIG. 2. The air blower 101 mainly differs from the air blower 1 (see FIG. 2) of the first embodiment in the position of a handle 116. Hereinafter, the air blower 101 will be explained in detail, but the common structural element as that of the air blower 1 of the first embodiment will be denoted by the same reference numeral, and the duplicated explanation thereof will be omitted.

The handle 16 of the air blower 1 of the first embodiment is arranged on the fan case 12. The handle 116 of the air blower 101 of the second embodiment is, however, arranged across the motor case 11 and the fan case 12 as shown in FIG. 6, more specifically, across and over the case 11*b* forming the motor case 11 and the case 12*a* forming the fan case 12. The handle 116 comprises two pieces of handle members 116*a*, 116*b* joined and fastened in the direction of the axial line 7. The handle member 116*a* is formed together with the case 11*a* forming the motor case 11. Moreover, the handle member 116*b* is formed together with the case 11*b* forming the motor case 11 and the case 12*a* forming the fan case 12.

According to the air blower 101 of the second embodiment, the same effect as that of the air blower 1 of the first embodiment can be accomplished, and because the handle 116 is arranged across and over the motor case 11 and the fan case 12, a weighted center position G (see FIG. 6) of the air blower 101 and the position of the handle 116 become much closer to each other in the direction of the axial line 7, thereby further improving the weight balance, resulting in an improvement of the workability.

<Third Embodiment>

Figure 7:
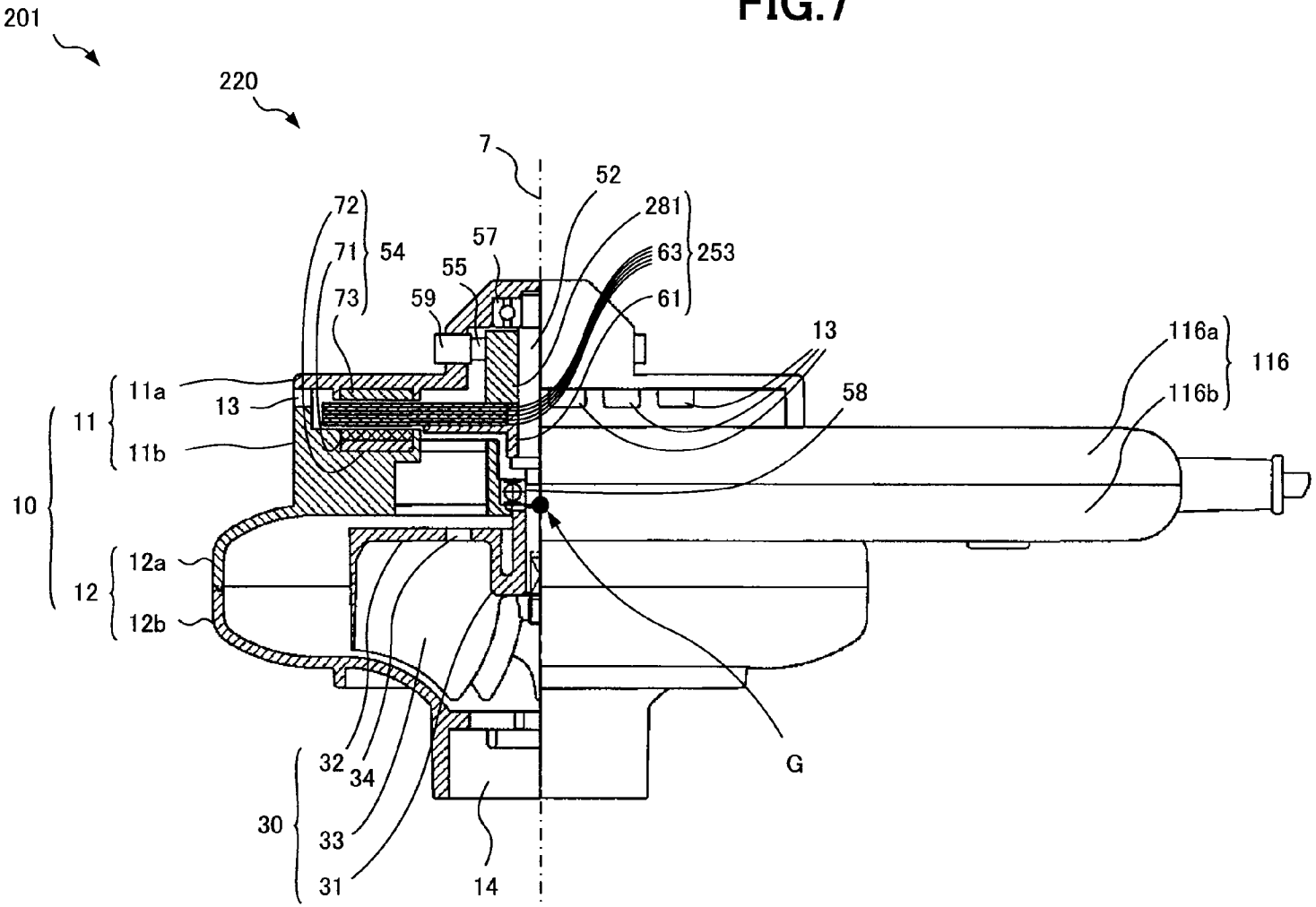
FIG. 7 is a cross-sectional view corresponding to FIG. 2 and showing an air blower according to a third embodiment of the present invention.

FIG. 7 is a cross-sectional view showing an air blower 201 according to a third embodiment and corresponding to FIG. 2. The air blower 201 mainly differs from the air blower 1 of the first embodiment in the structure of a motor 220. The air blower 201 will be explained in detail, but the common structural element as that of the air blower 1 of the first embodiment will be denoted by the same reference numeral, and the duplicated explanation thereof will be omitted.

Figure 8:
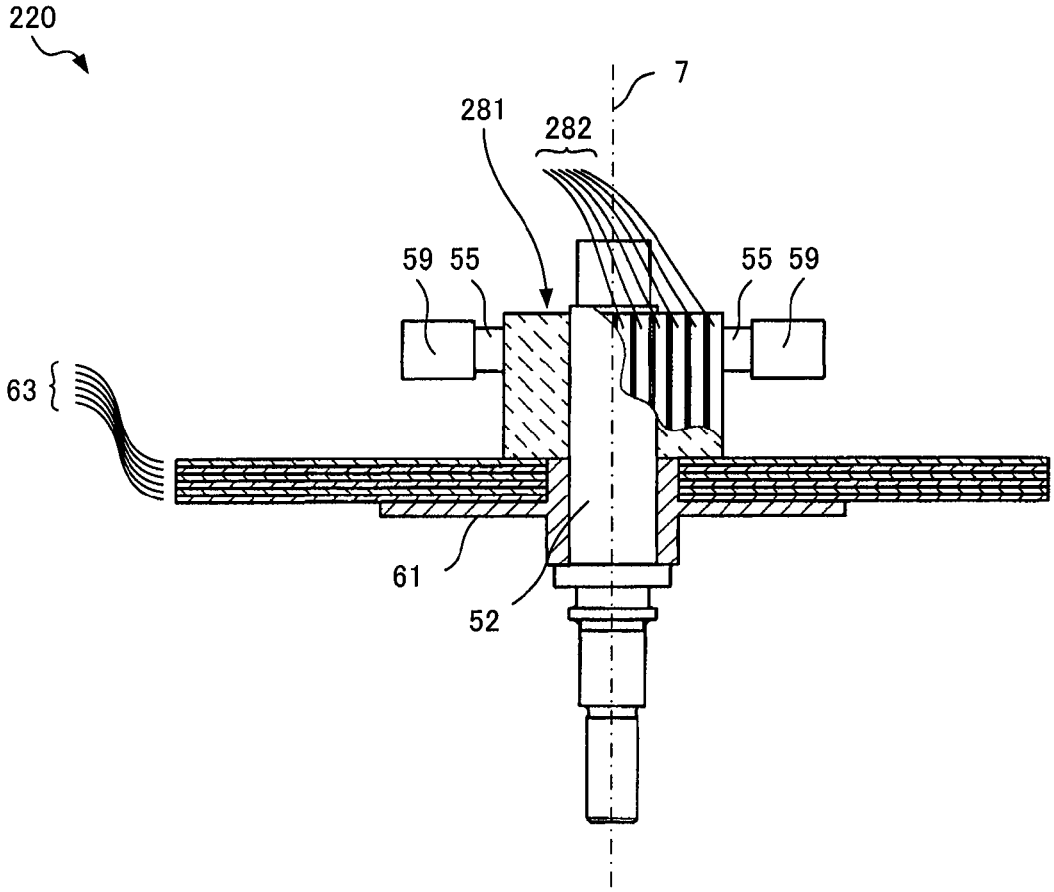
FIG. 8 is a cross-sectional view showing a major part of a motor shown in FIG. 7.

The motor 20 of the air blower 1 of the first embodiment has the coil/commutator disc 62 having the commutator 81 (see FIG. 4) formed by the conductor pattern on the top face thereof. The motor 220 of the air blower 201 of the third embodiment has, however, a circular-cylindrical commutator 281 arranged on the top face of the coil disc 63 as shown in FIG. 7. As shown in FIG. 8, the commutator 281 comprises a plurality of commutator pieces 282 arranged on the side face of the cylinder around the axial line 7. Each commutator piece 282 is formed by, for example, mechanical machining, and is electrically connected to the corresponding coil 91*c* (see FIG. 5) of the coil disc 63. According to the third embodiment, the sliders 55 are arranged so as to slidingly contact the outer circumferential surface of the commutator 281 in a direction substantially orthogonal to the axial line 7.

As explained above, according to the air blower 201 of the third embodiment, because the sliders 55 slidingly contact the outer circumference surface of the commutator 281 in a direction substantially orthogonal to the axial line 7, in comparison with the air blower 1 of the first embodiment having the sliders 55 slidingly contacting the commutator 81 in a direction substantially parallel to the axial line 7, surface wobbling originating from force received from the sliders 55 and a distortion of the rotor 54 hardly occurs, and the rotation of the rotor 54 and the contact between the rotor 54 and the sliders 55 become stable. Moreover, because the commutator piece 282 formed by mechanical machining or the like can be easily formed so as to be thick in comparison with the commutator piece 82 formed by a conductor pattern, a damage originating from ablation with the sliders 55 can be suppressed. Therefore, according to the motor 220 with the above-explained structure, in comparison with the motor 20 of the first embodiment, a high efficiency and a long life of the motor can be easily accomplished.

<Fourth Embodiment>

Figure 9:
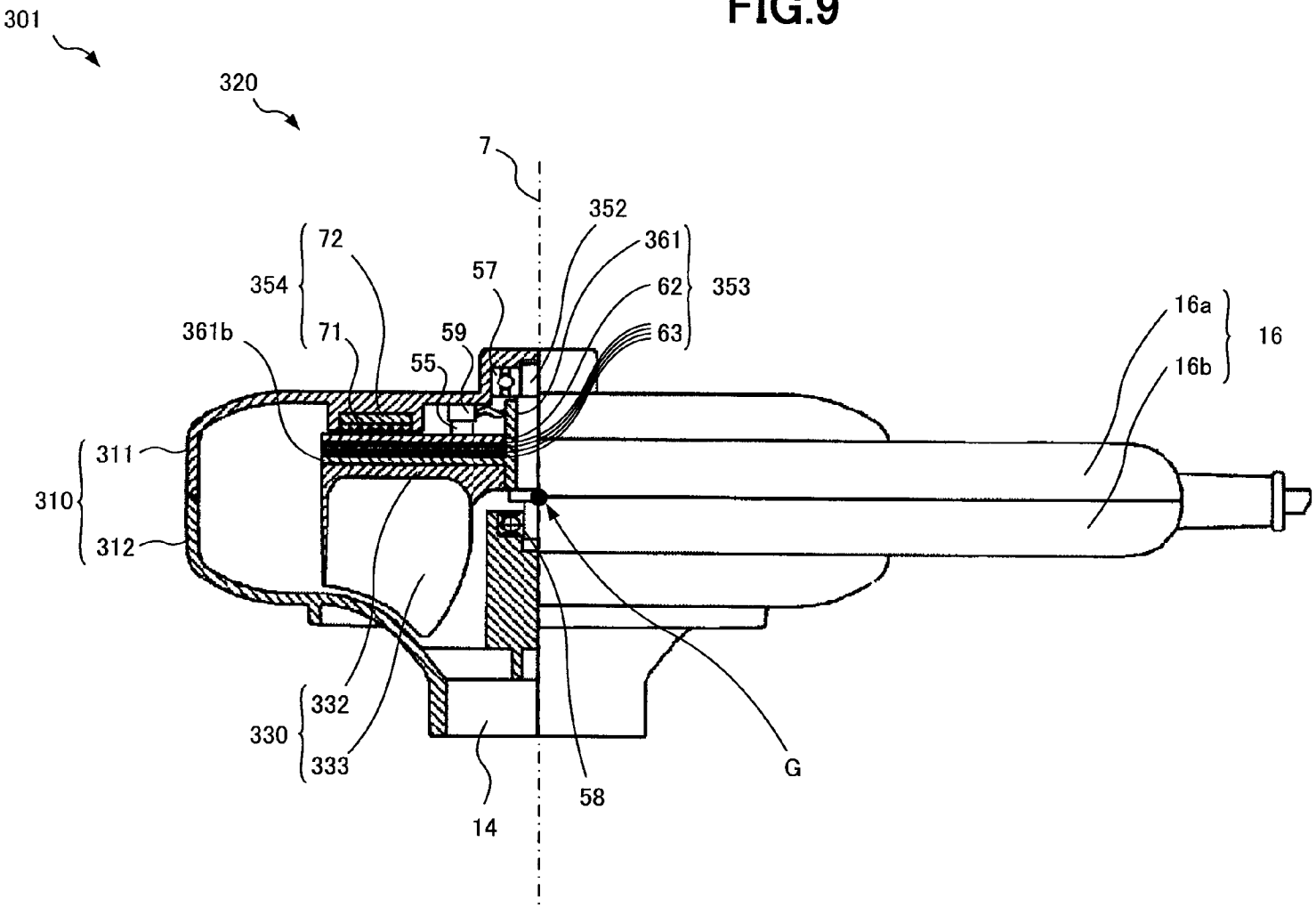
FIG. 9 is a cross-sectional view corresponding to FIG. 2 and showing an air blower according to a fourth embodiment of the present invention.

FIG. 9 is a cross-sectional view showing an air blower 301 according to a fourth embodiment and corresponding to FIG. 2. The air blower 301 mainly differs from the air blower 1 of the first embodiment in a method of coupling a motor 320 to a fan 330 and in the structure of a corresponding casing 310. The air blower 301 will be explained in detail, but the common structural element to that of the air blower 1 of the first embodiment will be denoted by the same reference numeral, and the duplicated explanation thereof will be omitted.

According to the air blower 1 of the first embodiment, the rotor 53 of the motor 20 and the fan 30 are coupled together in such a manner as to be apart from each other in the direction of the axial line 7. According to the third embodiment, however, as shown in FIG. 9, a rotor 353 of the motor 320 and the fan 330 are provided together and adjoined to each other in the direction of the axial line 7.

In association with this configuration, the casing 310 that retains the motor 320 and the fan 330 comprises a motor case 311 and a fan case 312 joined and fastened across the rotor 353 and the fan 330 in the direction of the axial line 7. The circular-cylindrical air outlet opening 15 (not shown) is dividingly formed in the motor case 311 and the fan case 312. The two pieces of handle members 16*a*, 16*b* forming the handle 16 are formed together with the motor case 311 and the fan case 312, respectively. An output shaft 352 of the motor 320 is rotatably supported by the bearing 57 provided at the motor case 311 and the bearing 58 provided at the fan case 312.

The rotor 353 of the motor 320 comprises a flange 361, the above-explained coil/commutator disc 62, and the above-explained coil disc 63. Although the flange 61 is formed of a metal like an aluminum alloy in the first embodiment, the flange 361 of the fourth embodiment is formed of a magnetic material like iron. Moreover, a support member 361*b* of the flange 361 has a substantially equal external diameter as those of the coil/commutator disc 62 and the coil disc 63, and is formed so as to cover the whole bottom face of the coil disc 63, i.e., the coil area 90*d* (see FIG. 3) of the coil disc 63.

A stator 354 of the motor 320 comprises the magnet 71, and the yoke 72, and is fixed to the motor case 311 so as to face the top face of the coil/commutator disc 62, more specifically, so as to face the coil area 90*a* (see FIG. 3).

The yoke 72 and the flange 361 (the support member 361*b*) form a magnetic path in such a way that magnetic fluxes generated by the magnet 71 pass through the coil/commutator disc 62 and the coil disc 63 in the direction of the axial line 7. That is, the magnet 71, the yoke 72, and the flange 361 (the support member 361*b*) configure the magnetic flux generating mechanism of the present invention.

The fan 330 comprises a discoid substrate member 332 fixed to the flange 361 of the rotor 353, and a plurality of blades 333 extending from the substrate member 332 opposite to the motor. The flange 361 and the fan 330 are provided together by, for example, bonding, fastening, or molding (e.g., integral molding) in such a way that the support member 361*b* of the flange 361 and the substrate member 332 of the fan 330 are adjoined to each other in the direction of the axial line 7. That is, the rotor 353 and the fan 330 are provided together so as to be adjoined to each other in the direction of the axial line 7.

According to the air blower 301 of the fourth embodiment, the same effect as that of the air blower 1 of the first embodiment can be accomplished, and because the rotor 353 and the fan 330 are adjoined to each other in the direction of the axial line 7 and are provided together, the width of the casing 310 in the direction of the axial line 7 can be reduced, thereby further improving the workability. Moreover, because the distance between the weighted center position G (see FIG. 9) and the handle 316 in the direction of the axial line 7 can be shortened, the weight balance can be further improved. Furthermore, the shape of the casing 310 can be simplified and the number of parts configuring the casing 310 can be reduced, so that the manufacturing cost of the parts and the assembling cost of the product can be reduced.

The present invention is not limited to the foregoing embodiments, and can be changed and modified in various forms within the scope and the spirit of the present invention.

Figure 10:
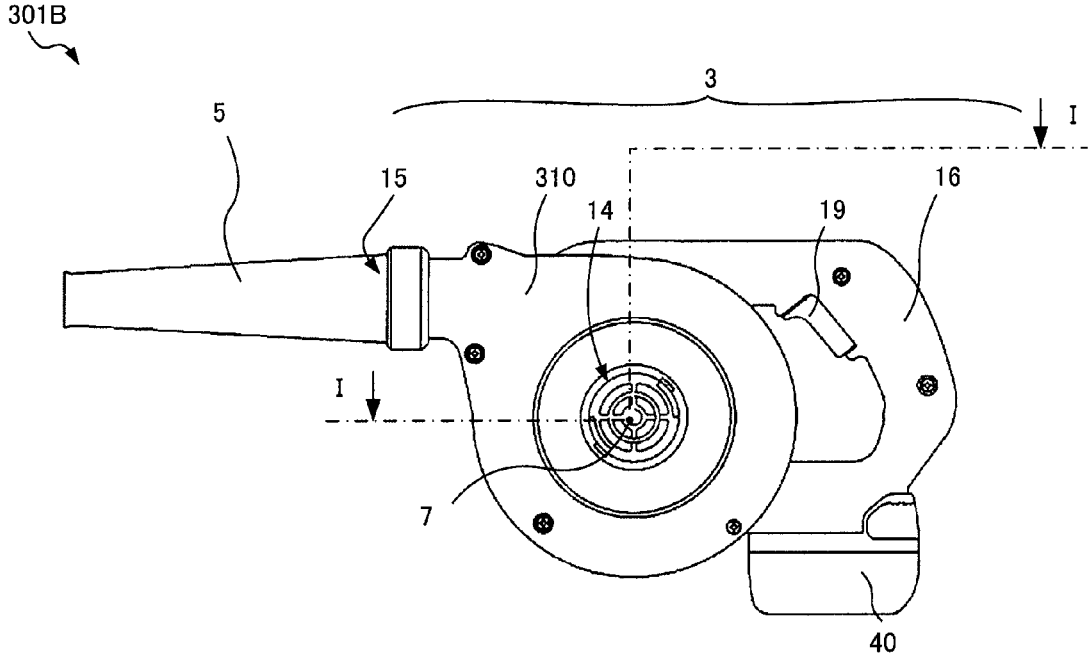
FIG. 10 is a side view showing an air blower according to a modified embodiment.
Figure 11:
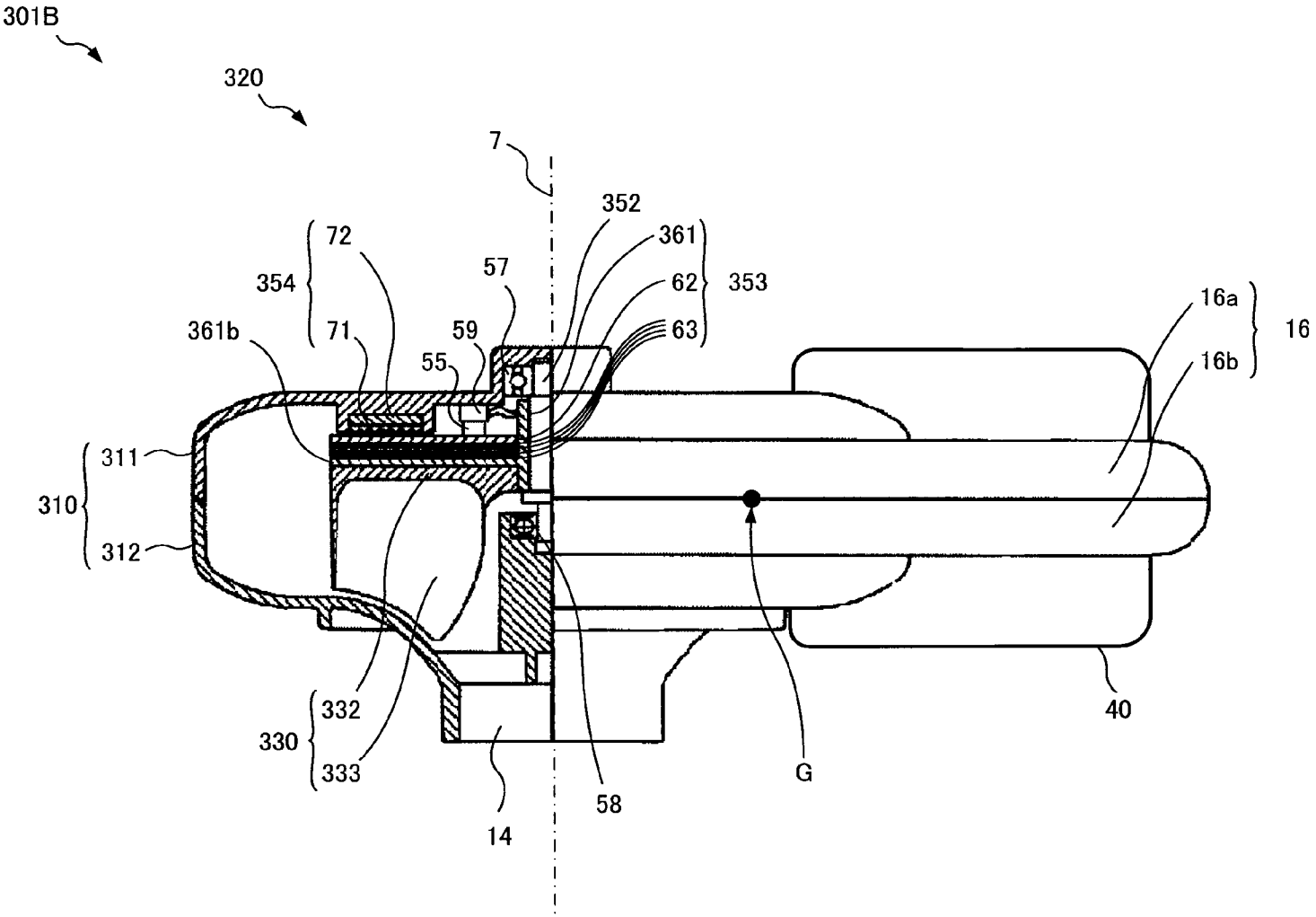
FIG. 11 is a cross-sectional view showing the air blower of the modified embodiment and corresponding to FIG. 7.

For example, according to the air blowers 1, 101, 201, and 301 of the foregoing embodiments, the power cord 18 with the power plug 17 is attached to the handles 16, 116, and as the power plug 17 is connected to an external AC power source, power from the AC power source is supplied to the motors 20, 220, and 320 through a non-illustrated power-source circuit. However, the power cord 18 with the power plug 17 can be provided at an arbitrary location in the air blowers 1, 101, 201, and 301, and instead of this configuration or in addition to this configuration, like an air blower 301B shown in FIGS. 10 and 11, a battery (power source) 40 like a secondary battery may be provided so as to be apart from the motor 20 and the fan 30 in a direction substantially vertical to the axial line 7. FIGS. 10 and 11 show an example in which the air blower 301 of the third embodiment has the battery 40 instead of the power cord 18. In the example shown in FIGS. 10 and 11, the battery 40 is provided on the same plane as that of the handle 16 and the air outlet opening 15 and rearwardly of the lower part of the air blower 301B. The battery 40 is provided at a location apart from the motor 20 and the fan 30 in a direction substantially vertical to the axial line 7. In this fashion, as the battery 40 and the air outlet opening and the handle are arranged on a substantially same plane, an offsetting between the weighted center position G of the air blower 1 and the handle 16 can be reduced, thereby obtaining a good weight balance. The battery 40 (the power source) may be provided in the casing 10 and may be rechargeable by connecting a non-illustrated cord, may be detachable to the casing 10 and may be replaceable, or may be charged by an external battery charger.

Moreover, the form of the coil formed in the coil disc, the arrangement of the polarity of the magnetic flux generating mechanism, etc., can be changed arbitrarily if a commutator motor is used.

The magnetic flux generating mechanism of the present invention is not limited to one having a magnet, but may be one having, for example, a coil, an electrical magnet or the like as long as it can generate magnetic fluxes passing through the coil disc in the direction of the axial line of the output shaft of the motor.

According to the air blowers 1, 101, 201, and 301, the motors 20, 220, and 320 are each a commutator motor that comprises the rotor 53, 253, or 353 including the coil/commutator disc 62 and the coil disc 63, and the stator 54 or 354 including the magnet 71. However, the motor built in the air blower of the present invention is not limited to this type, and for example, may be a brushless motor comprising a rotor with a magnet and a stator with a coil disc.

The coil/commutator disc 62 and the coil disc 63 of the foregoing embodiments each comprise a print wiring board, but the coil disc of the present invention is not limited to this type, and for example, may be a plurality of thin coils or the like arranged in a discoid shape.

In the first to third embodiments, the fan 30 is directly coupled to the output shaft 52 of the motors 20, 220, but the fan of the present invention is not limited to this type, and may be linked to the output shaft of the motor through a power transmitting mechanism, such as a gear or a belt, as long as it can rotate by receiving power from the motor.

The structures explained in the first to fourth embodiments may be combined one another.

Furthermore, the material, the shape, the number, the arrangement, etc., of each structural element can be changed and modified as long as the object of the present invention can be accomplished.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. An air blower comprising:

a motor including a rotor, a stator, and an output shaft fixed to the rotor, one of the rotor and the stator including a coil disc with a plurality of coil pieces arranged in a circumferential direction around the output shaft as viewed from a direction of an axial line of the output shaft, and another of the rotor and the stator including a magnetic flux generating mechanism that generates a magnetic flux passing through the coil disc in the direction of the axial line of the output shaft;

a fan which rotates by receiving power from the motor;

a casing which retains the motor and the fan, and which is provided with an air inlet opening for suctioning air and an air outlet opening for blowing out the air; and a handle provided at the casing, wherein the fan and the motor each have a discoid shape and a rotational surface located in parallel with each other, and a weighted center position of the air blower is spaced from the rotor in a direction along or in parallel with the direction of the axial line.

2. The air blower according to claim 1, wherein the coil disc comprises a print wiring board where a conductor pattern of any one of the plurality of coil pieces is formed.

3. The air blower according to claim 1, wherein the rotor and the fan are provided together so as to be adjoined to each other in the direction of the axial line of the output shaft.

4. The air blower according to claim 1, wherein the handle is arranged so as to be apart from the motor and the fan in a radially outward direction of the axial line of the output shaft.

5. The air blower according to claim 4, wherein the air outlet opening and the handle are arranged on a substantially same plane.

6. The air blower according to claim 4, wherein the casing further comprises a motor case for retaining the rotor, wherein the handle is arranged on the fan case.

7. The air blower according to claim 4, wherein the casing comprises:

a motor case for retaining the rotor; and a fan case which retains the fan and which is provided with the air inlet opening and the air outlet opening, and the handle is arranged on and across the motor case and the fan case.

8. The air blower according to claim 1, wherein the handle is formed together with the casing.

9. The air blower according to claim 6, wherein the handle is formed together with the fan case.

10. The air blower according to claim 7, wherein the handle comprises first and second handle members joined together in the direction of the axial line of the output shaft, and either one of the first and second handle members is formed together with the fan case or the motor case.

11. The air blower according to claim 1, wherein an external diameter of the coil disc is larger than an external diameter of the fan.

12. The air blower according to claim 1, wherein the magnetic flux generating mechanism includes a magnet.

13. The air blower according to claim 1, further comprising a battery pack, wherein the battery pack and the air outlet opening and the handle are arranged on a substantially same plane.

14. The air blower according to claim 1, wherein the weighted center position of the air blower is spaced from the rotor in a direction along the direction of the axial line.

* * * * *